US009225130B2

(12) United States Patent
Zhang et al.

(10) Patent No.: US 9,225,130 B2
(45) Date of Patent: Dec. 29, 2015

(54) CONNECTOR HAVING STIFFENER COATED WITH INSULATIVE LAYER

(71) Applicant: FOXCONN INTERCONNECT TECHNOLOGY LIMITED, Grand Cayman, KY (US)

(72) Inventors: Lin Zhang, HuNan (CN); Wei-De Zhang, Shenzhen (CN); Shi-Jie Tan, Shenzhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/520,311

(22) Filed: Oct. 21, 2014

(65) Prior Publication Data

US 2015/0111436 A1 Apr. 23, 2015

(30) Foreign Application Priority Data

Oct. 21, 2013 (CN) ..... 2013 1 0491213

(51) Int. Cl.

| | |
|---|---|
| ***H01R 13/60*** | (2006.01) |
| ***H01R 24/62*** | (2011.01) |
| ***H01R 13/405*** | (2006.01) |
| *H01R 12/72* | (2011.01) |
| *H01R 13/6594* | (2011.01) |
| *H01R 43/24* | (2006.01) |

(52) U.S. Cl.

CPC ..... *H01R 24/62* (2013.01); *H01R 13/405* (2013.01); *H01R 12/724* (2013.01); *H01R 13/6594* (2013.01); *H01R 43/24* (2013.01)

(58) Field of Classification Search

CPC ..... H01R 33/7628; H01R 23/7042

USPC ..... 439/569, 573, 500, 567, 80, 79

See application file for complete search history.

(56) References Cited

U.S. PATENT DOCUMENTS

| | | | | |
|---|---|---|---|---|
| 7,422,475 | B2 | 9/2008 | Hirata | |
| 7,682,199 | B2 | 3/2010 | Ahn et al. | |
| 8,764,484 | B2 * | 7/2014 | Zhang et al. | 439/607.36 |
| 2012/0295481 | A1 * | 11/2012 | Zhang | 439/607.22 |
| 2013/0149906 | A1 | 6/2013 | Kim et al. | |
| 2013/0149915 | A1 | 6/2013 | Kim et al. | |
| 2013/0164982 | A1 * | 6/2013 | Zhang et al. | 439/607.46 |
| 2013/0183867 | A1 * | 7/2013 | Wu et al. | 439/668 |
| 2014/0315439 | A1 * | 10/2014 | Zhang | 439/626 |

FOREIGN PATENT DOCUMENTS

| | | |
|---|---|---|
| JP | 4875130 | 2/2012 |

* cited by examiner

*Primary Examiner* — Phuongchi T Nguyen

(74) *Attorney, Agent, or Firm* — Wei Te Chung; Ming Chieh Chang

(57) ABSTRACT

An electrical connector (100) includes an insulative housing (1), a plurality of terminals (2) retained in the insulative housing (1), and a stiffener (3) affixed to the insulative housing (1). The insulative housing (1) includes a base portion (11) and a tongue portion (12) extending forwardly from the base portion (11). The tongue portion (12) defines a plurality of terminal-receiving slots (1221) and includes an upper surface (121), a bottom surface (122), a pair of side surfaces (123) and a fore-end surface (124). The stiffener (3) has a top plate (31) covering the upper surface (121) of the tongue portion (12) and an insulative layer (30) plating therein. The stiffener (3) defines an insulative region (313) against which a plurality of molds resisted in insert-molding the stiffener (3) with the insulative housing (1), said insulative region (313) coated with an insulative layer (30).

18 Claims, 11 Drawing Sheets

CONNECTOR HAVING STIFFENER COATED WITH INSULATIVE LAYER

BACKGROUND OF THE INVENTION

1. Field of the Invention

The present invention relates generally to an electrical connector, and more particularly to an electrical connector having a stiffener capable of avoiding a fire.

2. Description of Related Arts

Universal Serial Bus (USB) interfaces are widely used in various electronic devices. In recent years, a micro USB interface is introduced to meet miniaturization and security requirement of electronic devices. U.S. Pat. No. 7,682,199 discloses an electrical connector comprising an insulative housing, a plurality of contacts retained in the insulative housing and a metal shell. The insulative housing has a flat plate-shaped fitting portion projecting from a body portion to fit to a mating connector. The fitting portion has first and second main surfaces that are opposite to each other and a pair of side surfaces connecting between the main surfaces. Each contact has a contacting portion disposed on the first main surface. The fitting portion is provided with a metal cover portion. The metal cover portion extends along a periphery of the fitting portion to cover the second main surface and the pair of side surfaces. However, the stiffener of prior art is usually made of metal sheet with a good conductivity to ensure enough intensity. It is easy to cause a fire or electric shock because of the matal plate's conduct when the electrical connector is mated with the mating connector. Moreover, the stiffener is placed close to the contacts for miniaturization so that there is an odds-on chance to produce a fire between the stiffener and the contacts, even contributes to damage to the connector or applicance.

An electrical connector having a matal plate capable of avoiding a fire is desired.

SUMMARY OF THE INVENTION

Accordingly, an object of the present invention is to provide an electrical connector having a matal plate capable of avoiding a fire.

To achieve the above object, An electrical connector comprising: an insulative housing having a base portion and a tongue portion extending forwardly from the base portion, the tongue portion defining a plurality of terminal-receiving slots and having an upper surface, a bottom surface, a pair of side surfaces and a fore-end surface; a plurality of terminals retained in the terminal-receiving slots of the insulative housing, each terminal having a contacting portion partly exposed to the bottom surface of the tongue portion; and a stiffener affixed to the insulative housing and having a top plate covering an upper surface of the tongue portion, said stiffener defines an insulative region against which a plurality of molds resisted in insert-molding the stiffener with the insulative housing, said insulative region plated with an insulative layer.

Other objects, advantages and novel features of the invention will become more apparent from the following detailed description when taken in conjunction with the accompanying drawings.

DETAILED DESCRIPTION OF THE PREFERRED EMBODIMENT

Figure 1:
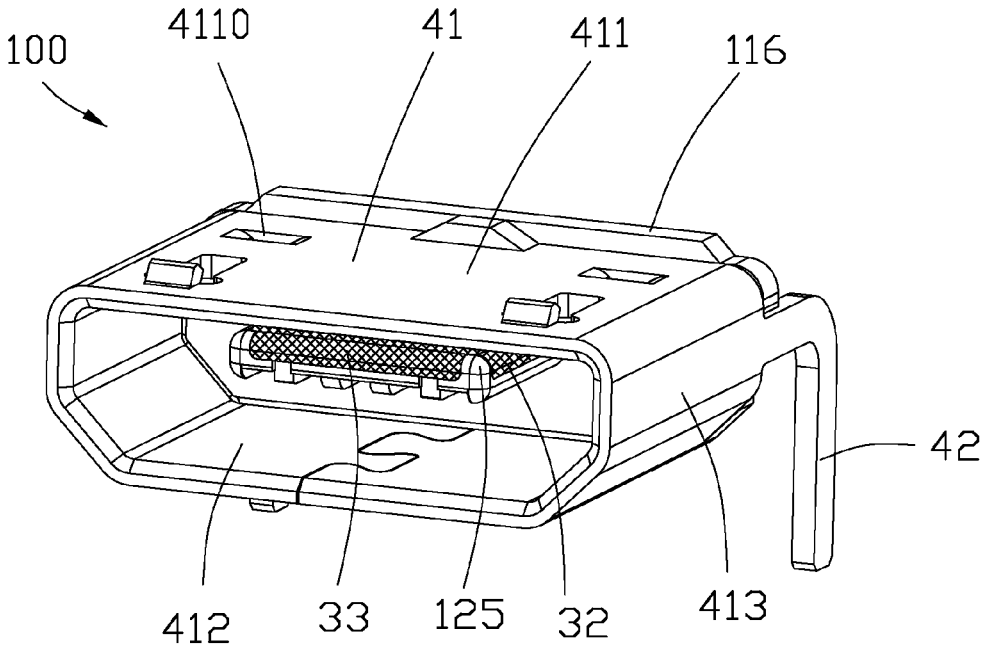
FIG. 1 is a perspective, assembled view of an electrical connector referred in a first embodiment.
Figure 2:
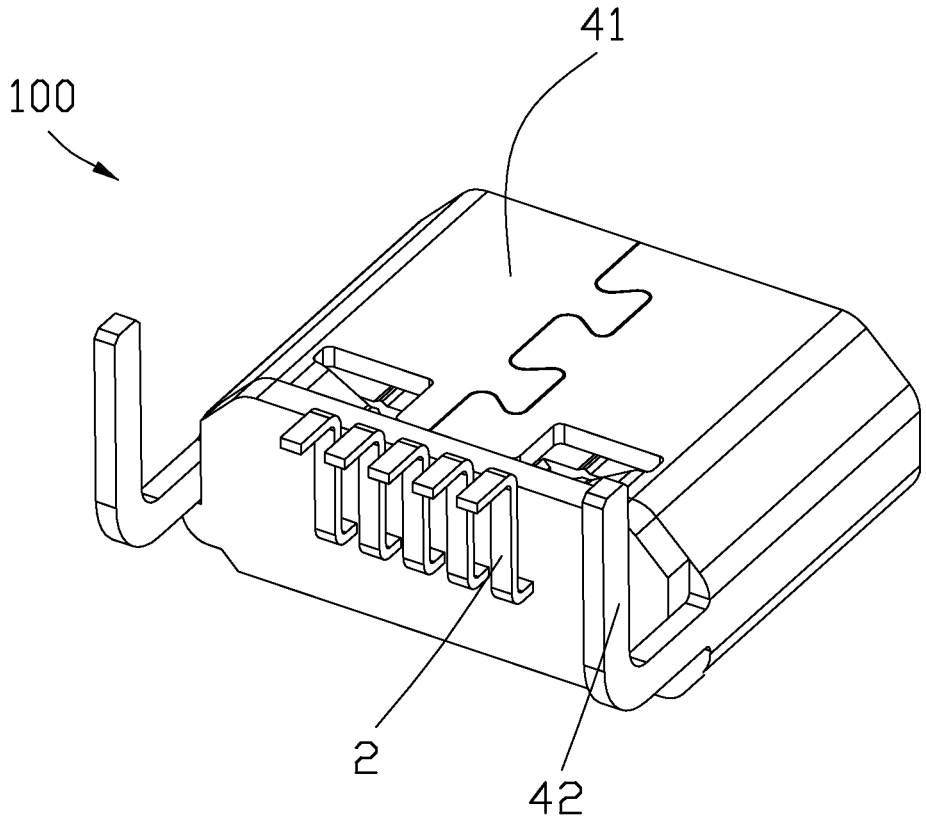
FIG. 2 is a perspective, assembled view of the electrical connector, taken from a different view with respect to FIG. 1.

Reference will now be made in detail to the preferred embodiment of the present invention.

Referring to FIGS. 1 to 11, an electrical connector 100 of the present invention comprises an insulative housing 1, a plurality of terminals or contacts 2 and a stiffener or shielding plate 3 affixed to the insulative housing 1 and a metal shell 4 enclosing the insulative housing 1. The electrical connector 100 defines a front-to-back direction and a tranverce direction perpendicular to the front-to-back direction in a horiszotal plane referring to FIG. 1.

Figure 3:
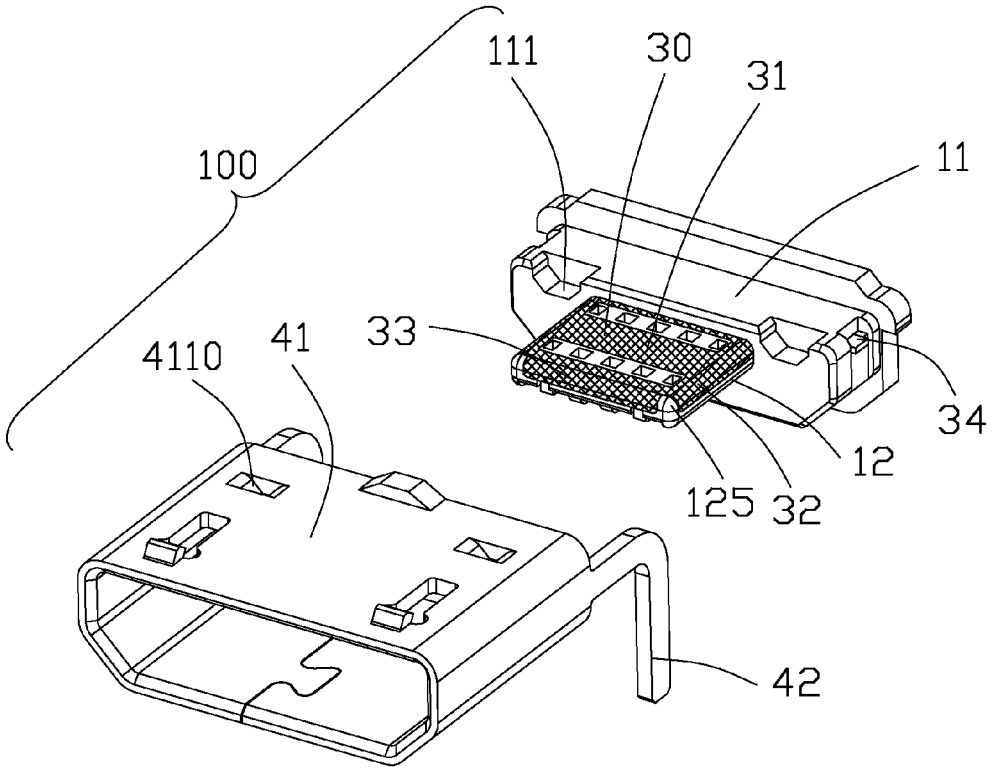
FIG. 3 is a perspective, partly exploded view of the electrical connector, showing a metal shell separated from an insulative housing.
Figure 4:
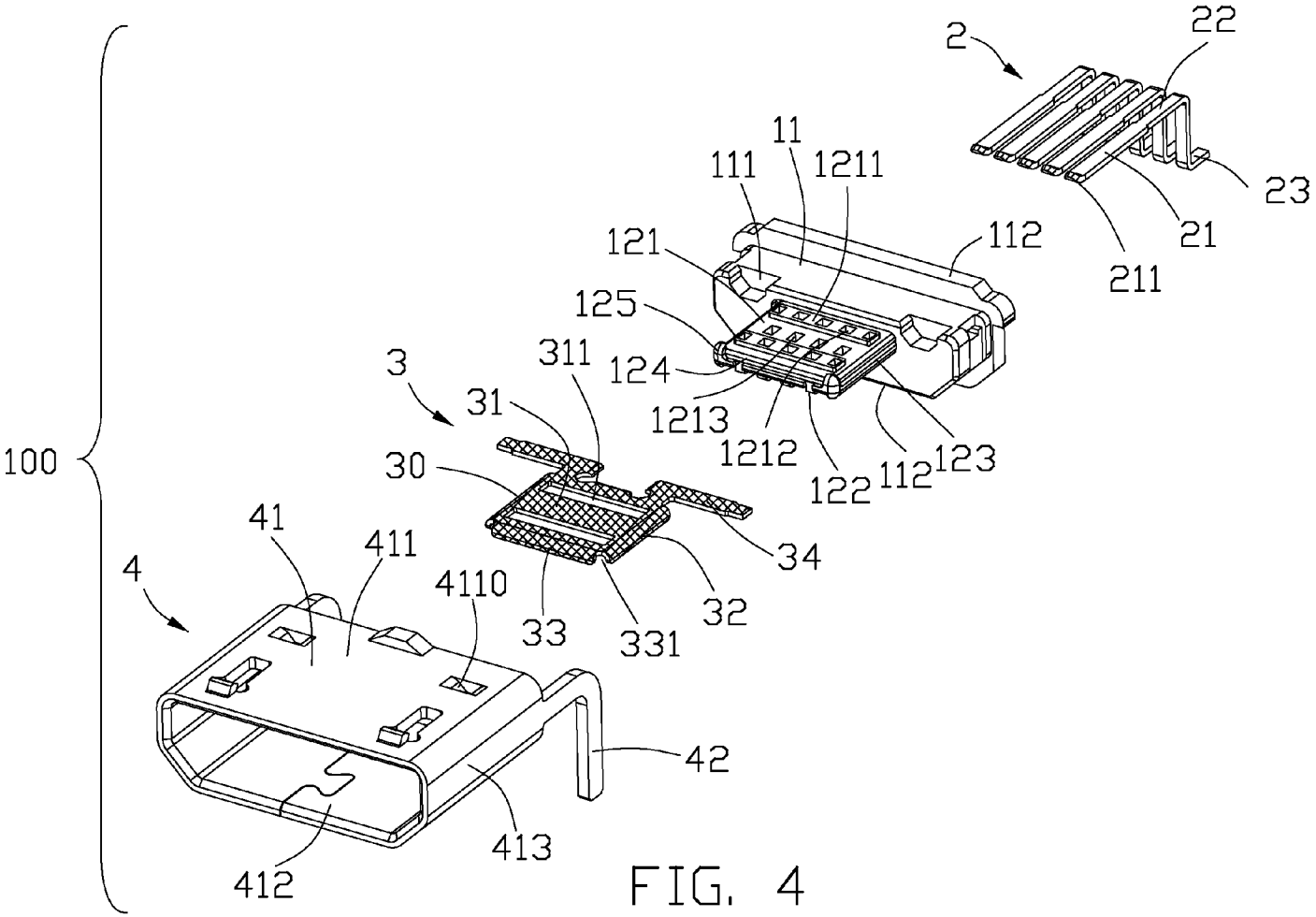
FIG. 4 is a perspective, exploded view of the electrical connector with respect to FIG. 1.
Figure 5:
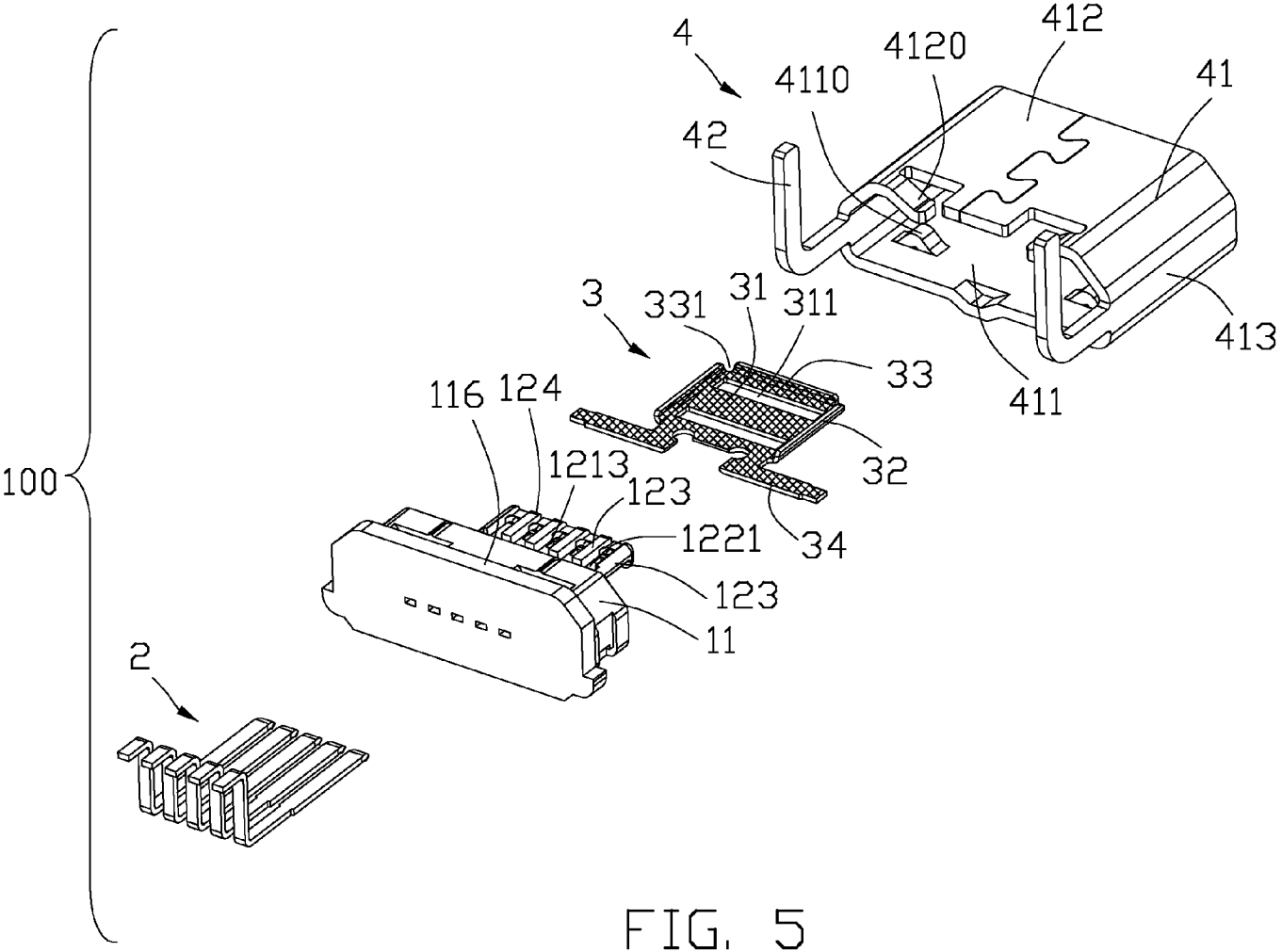
FIG. 5 is a perspective, exploded view of the electrical connector, taken from a different view with respect to FIG. 4.

Referring to FIGS. 3 to 5, the insulative housing 1 comprises a base portion 11 and a tongue portion 12 extending forewardly from the base portion 11. The top of the base portion 11 is formed with a pair of recesses 111. The insulative housing 1 has numbers of resisting boards 112 located around the base portion 11 in a horiszotal plane. The tongue portion 12 defines an upper surface 121, a bottom surface 122, a pair of side surfaces 123 and a fore-end surface 124. The upper surface 121 is formed with a pair of protruding boards 1211, numbers of first apertures 1212 and second apertures 1213. Each protruding board 1211 is shaped like a narrow strip and extends along a left-to-right direction. The two protruding boards 1211 are spaced at regular intervals along a front-to-back direction to firmly fix with the stiffener 3. The second apertures 1213 are located between the two protruding boards 121 in a line. The bottom surface 122 is formed with numbers of terminal-receiving slots 1221 communicating with the corresponding first apertures 1212 for receiving the terminals 2. Each second aperture 1213 is placed between every two contiguous terminal-receiving slots 1221. The first apertures 1212 are used to locate the molds (not shown) used to confine the terminals 2, while the second apertures 1213 communicate with the terminal-receiving slots 1221 to locate the molds f used to confine the stiffener 3 in insert-molding the stiffener 3 with the insulative housing 1. Both sides of the fore end of the tongue portion 12 are formed with a projection 125 to cooperate with the stiffener 3.

Referring to FIGS. 1 to 2 and 4 to 5, Each terminal 2 comprises a panel-shaped contacting portion 21 received in the terminal-receiving slot 1221, a fixing portion 22 retained in the insulative housing 1 and a soldering portion 23 for soldering onto a printed circuit board (not figured). Each contacting portion 21 is exposed to the bottom surface 122 of the tongue portion 12 and formed with a curved portion 211 on a free end. Each curved portion 211 is embedded the tongue portion 12 to increase the holding force between the terminals 2 and tongue portion 12 so that it prevents the contacting portions 21 of the terminals 2 warping upwardly and seperating from the tongue portion 2. In this embodiment, the number of the terminals 2 is five and the array of the terminals 2 meet the interface standard of a Micro USB. Therefore, the number of the first apertures 1212 in each row is five and the number of the second apertures 1213 is four.

Referring to FIGS. 3 to 5, the stiffener 3 comprises a top plate 31 covering the upper surface 121 of the tongue portion 12, a pair of side plates 32 bent and extending along both sides of the top plate 31, a fore plate 33 bent and extending from the front of the top plate 31 and a pair of fixed plates 34 extending lateraly from the both sides of the top plate 31. The two side plates partly cover the two side surfaces 123 of the tongue portion 12 and the fore plate 33 partly covers the fore-end surface 124 of the tongue portion 12. The two fixed plates 34 are respectively placed in the two sides of a rear end of the top plate 31 and partly retained in the base portion 11 while the fixed plates 34 are partly exposed to the base portion 11. The top plate 31 has a pair of grooves 311 corresponding to the protruding board 1211 of the tongue portion 12. The stiffener 3 is formed with a vacant portion 331 located between the side boards 32 and the fore board 33 and corresponding to the projections 125 of the tongue portion 12.

The stiffener 3 is made of a metal sheet and defines an insulative region 313 with an insulative layer 30 formed on. A plurality of molds are resisted by the insulative region 313 in insert-molding the stiffener 3 with the insulative housing 1.

Referring to FIGS. 1 to 5, the metal shell 4 includes a tube-shaped main body 41 and a pair of soldering legs 42 bent and extending downwardly from main body 41. A rear edge of the main body 41 resists against the resisting board 112. The main body 41 includes a top wall 411, a bottom wall 412 and a pair of side walls 413 connecting the top wall 411 and the bottom wall 412. The top wall 411 has a pair of sunken portion 4110 resisted against the recess 111.

Referring to FIGS. 1 to 5, in a first embodiment, the insulative layer 30 covers all the surfaces of the stiffener 3 containing the insulative region 313 so that the stiffener 3 gets the much more efficient insulation. However, considering products' practical requirements and the production costs, it is not necessary to coat the stiffener 3 completely with the insulative materials on many occasions.

Figure 6:
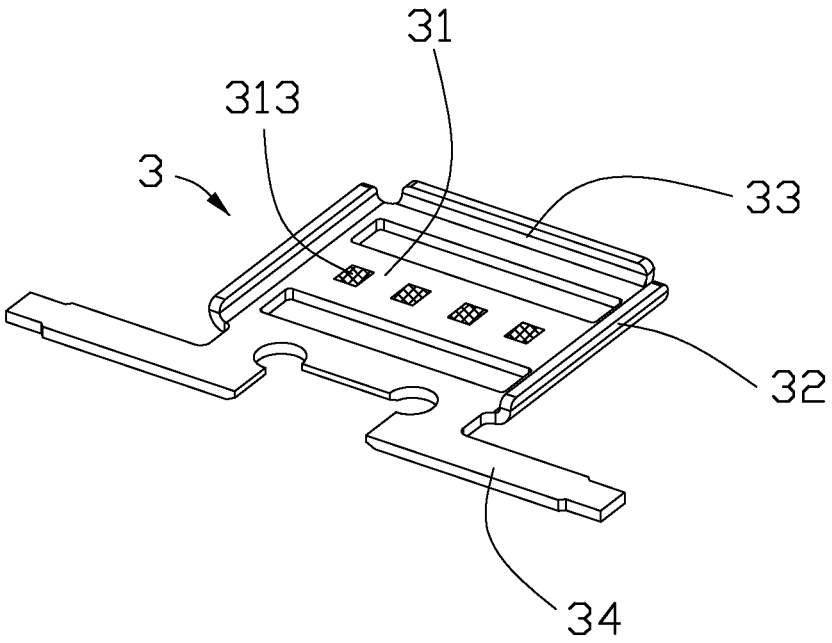
FIG. 6 is a perspective view of a stiffener of the electrical connector referred in a second embodiment.
Figure 7:
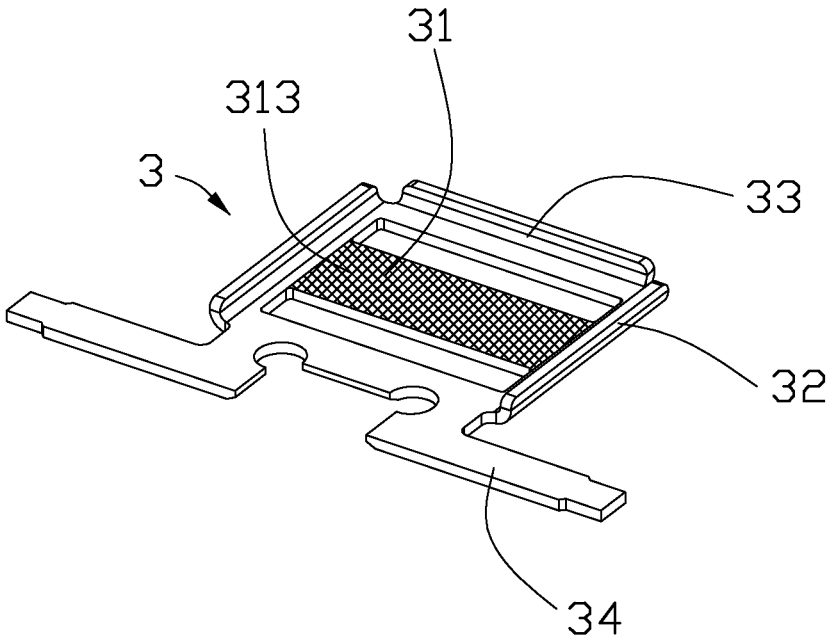
FIG. 7 is a perspective view of a stiffener of the electrical connector referred in a third embodiment.
Figure 8:
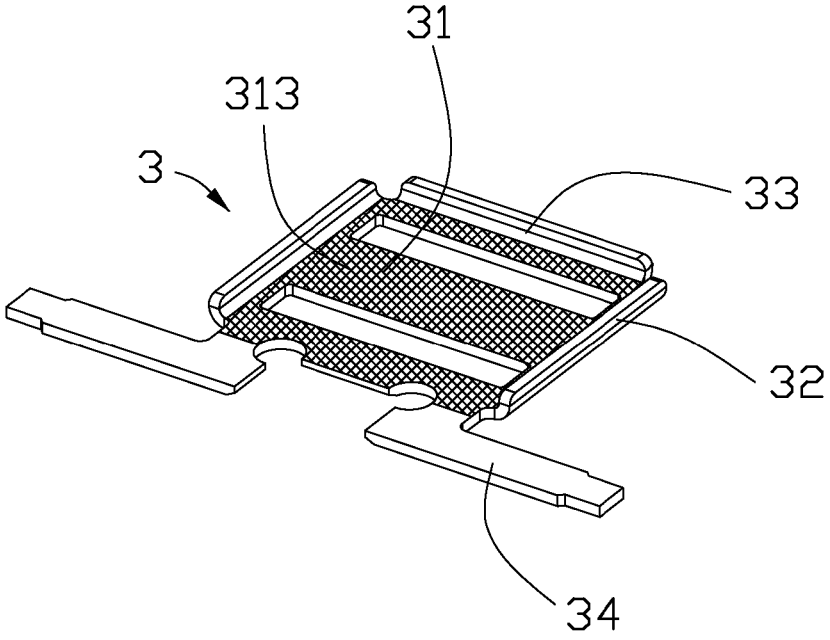
FIG. 8 is a perspective view of a stiffener of the electrical connector referred in a forth embodiment.
Figure 9:
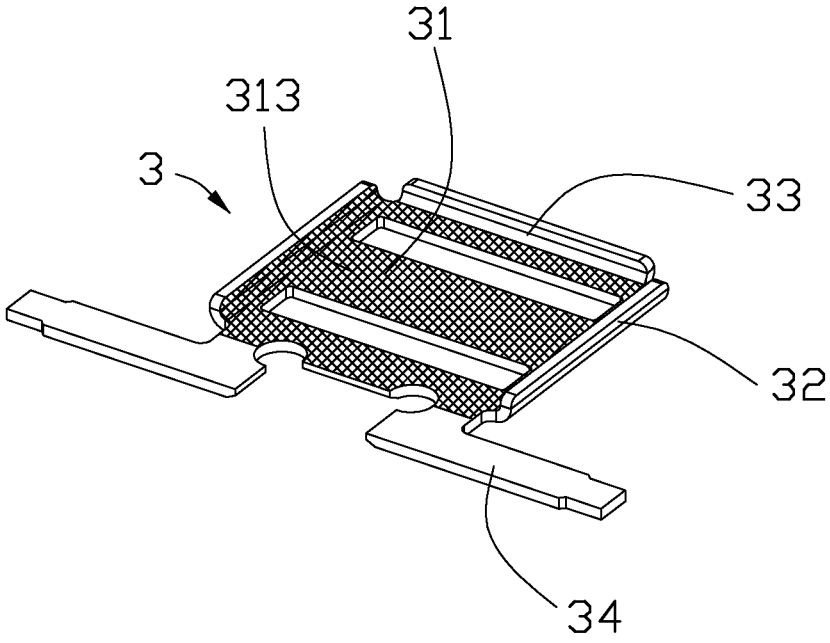
FIG. 9 is a perspective view of a stiffener of the electrical connector referred in a fifth embodiment.
Figure 10:
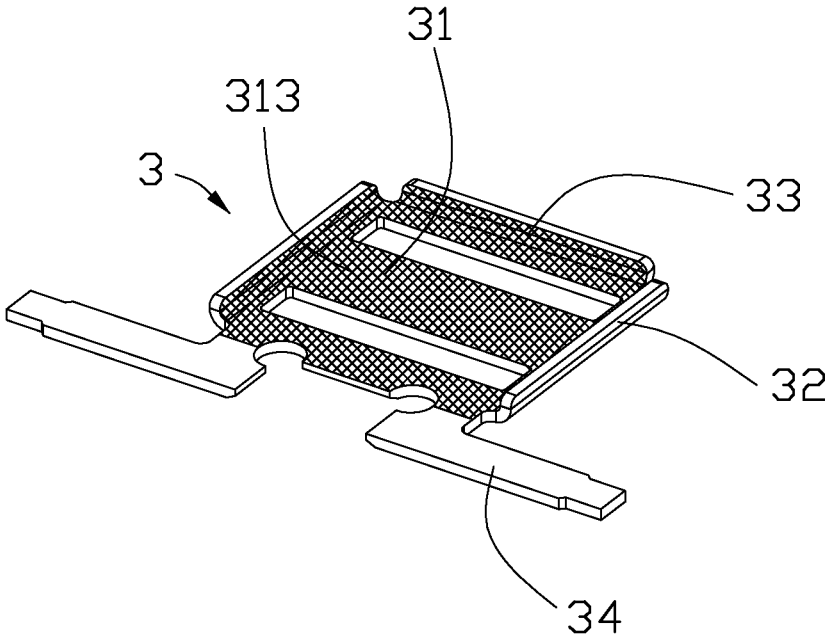
FIG. 10 is a perspective view of a stiffener of the electrical connector referred in a sixth embodiment.
Figure 11:
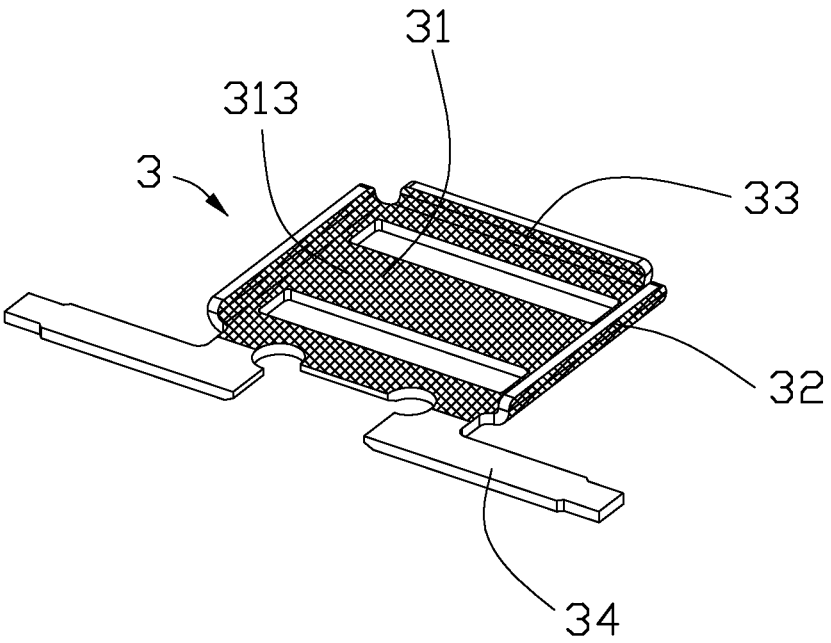
FIG. 11 is a perspective view of a stiffener of the electrical connector referred in a seventh embodiment.

Referring to FIG. 6, in a second embodiment, the insulative region 313 consists of a plurality of insulative segments corresponding to the second aperture 1213 accommodating the molds and coated with the insulative layers 30. Referring to FIG. 7, in a third embodiment, the insulative layer 30 is coated on the insulative region 313 and extends to the whole surface between the two grooves 311 of the top plate 31.

Referring to FIGS. 8 to 11, in forth to seventh embodiments, the insulative layer 30 is coated on the insulative region 313 of the top plate 31 and extends to the whole inner surface of the top plate 31. The insulative layer 30 further extends to an inner surface or an outer surface of the side plates 32 or all above. Besides, the insulative layer even extends to an inner surface or an outer surface of the fore plate 33 or all above.

Referring to FIGS. 5 to 11, the differences of the first embodiment to seventh embodiment are the locations and the dimensions of the insulative layer 30. In practice, the location of the insulative layer 30 is optionally placed to meet the different insulative requirement. However, the insulative layer 30 at least should be coated on the insulative region 313 of the stiffener 3.

The material of the insulative layer 30 can be PTFE (short for Polytetrafluoroethylene), resin or an insulative lacquer and so on. The insulative layer 30 is coated to the stiffener 3 via an electroplating process, electrophoresis or direct daubing in the present invention. In addition, the insulative layer 30 of the stiffener 3 is treated by oxidation and formed as an insulative oxide layer.

Due to the oriental holes accommodating the molds like the second aperture 1213, the stiffener 3 facing the tongue portion 12 is close to the terminals 2. Therefore, the insulative layer 30 formed on the insulative region 313 can effectively prevent a fire produced by the bad and wrong contact between the terminal 2 and the stiffener 3.

While a preferred embodiment in accordance with the present invention has been shown and described, equivalent modifications and changes known to persons skilled in the art according to the spirit of the present invention are considered within the scope of the present invention as described in the appended claims. Understandably, the apertures 1212 or 1213 may be later filled with insulative material optionally so as to prevent the terminals 2 and the stiffener 3 from being exposed to the opposite surfaces via such apertures 1212 or 1213 and further reinforce the strength of the whole tongue portion 12, once the housing 1 and the terminals 2 and stiffener 3 are secured together via an insert-molding process.

What is claimed is:

1. An electrical connector comprising: an insulative housing having a base portion and a tongue portion extending forwardly from the base portion, the tongue portion defining a plurality of terminal-receiving slots and having an upper surface, a bottom surface, a pair of side surfaces and a fore-end surface;

a plurality of terminals retained in the terminal-receiving slots of the insulative housing, each terminal having a contacting portion partly exposed to the bottom surface of the tongue portion; and a stiffener affixed to the insulative housing and having a top plate covering an upper surface of the tongue portion, said stiffener defines an insulative region against which a plurality of molds resisted in insert-molding the stiffener with the insulative housing, said insulative region coated with an insulative layer;

wherein said top plate of the stiffener is formed with a pair of grooves extending transversely and arranged along a front-to-back direction, and the insulative layer is formed between the pair of grooves and facing the tongue portion.

2. The electrical connector as claimed in claim 1, wherein said insulative layer is at least formed on a surface of the top plate facing the tongue portion.

3. The electrical connector as claimed in claim 1, wherein said tongue portion has a plurality of second apertures communicating with the terminal-receiving slots for accommodating a plurality of molds, and the insulative region consists of a plurality of insulative segments plated with the insulative layer corresponding to the second apertures.

4. The electrical connector as claimed in claim 1, wherein said stiffener further has a pair of side plates extending laterally from the top plate and at least covering part of the side surfaces of the tongue portion and said insulative layer extends to the surfaces of the side plates.

5. The electrical connector as claimed in claim 1, wherein said stiffener further has a fore plate extending forwardly from the top plate and covering at least part of the fore-end surface of the tongue portion and said insulative layer extends to the surface of the fore plate.

6. The electrical connector as claimed in claim 1, wherein said stiffener also has a fixed plate extending laterality from a rear edge of the top plate and retained in the base portion of the insulative housing.

7. The electrical connector as claimed in claim 1, wherein said insulative layer of the stiffener is made of Polytetrafluoroethylene, resin or an insulative lacquer.

8. The electrical connector as claimed in claim 1, wherein said insulative layer of the stiffener is plated to the stiffener via an electroplating process, electrophoresis or direct daubing or said insulative layer is treated by oxidation and formed as an insulative oxide layer.

9. An electrical connector comprising: an insulative housing including a base and a mating tongue extending forwardly therefrom in a front-to-back direction, the mating tongue forming opposite surfaces in a vertical direction perpendicular to said front-to-back direction;

a plurality of contacts disposed in the housing with contacting sections exposed upon the first surface;

a metallic shielding plate applied upon the second surface;

the shielding plate and the contacts and the housing being commonly secured together via an insert-molding process;

a plurality of first through holes extending through the mating tongue in the vertical direction, aligned with the corresponding contacts around the first surface, respectively, and exposed to an exterior around the second surface upon finishing the insert-molding process;

a plurality of second through holes extending through the mating tongue in the vertical direction, and alternately arranged with the contacting sections of the corresponding contacts, in a transverse direction perpendicular to both said front-to-back direction and said vertical direction; wherein each of said second through holes is exposed to the exterior around the first surface upon finishing said insert-molding process and covered by the shielding plate around the second surface in the vertical direction; wherein the shield plate defines a plurality of insulative regions at least confronting and aligned with the corresponding second through holes in the vertical direction, respectively;

wherein said insulative region is an insulative layer coated upon the shielding plate.

10. The electrical connector as claimed in claim 9, wherein each of said insulative regions is rectangular.

11. The electrical connector as claimed in claim 9, wherein the first through holes are dimensioned and configured to be used with core pins of a mold for supporting the contacting sections, and the second through holes are dimensioned and configured to be used with core pins of another mold for supporting the shielding plate during the insert-molding process.

12. The electrical connector as claimed in claim 9, wherein the mating tongue forms at least one raised portion around the second surface corresponding to the first through holes, and the shielding plate forms at least one opening to receive said raised portion therein so as to isolate the shielding plate from said first through holes transversely.

13. The electrical connector as claimed in claim 12, wherein the first through holes and the second through holes are not filled with external material after the insert-molding process is finished.

14. The electrical connector as claimed in claim 12, wherein the raised portion surrounds the corresponding second through holes.

15. An electrical connector comprising: an insulative housing including a base and a mating tongue extending forwardly therefrom in a front-to-back direction, the mating tongue forming opposite surfaces in a vertical direction perpendicular to said front-to-back direction;

a plurality of contacts disposed in the housing with contacting sections exposed upon the first surface;

a metallic shielding plate applied upon the second surface;

the shielding plate and the contacts and the housing being commonly secured together via an insert-molding process;

a plurality of through holes extending through the mating tongue in the vertical direction, and alternately arranged with the contacting sections of the corresponding contacts, in a transverse direction perpendicular to both said front-to-back direction and said vertical direction; wherein each of said through holes is exposed to an exterior around the first surface upon finishing the insert-molding process, and covered by the shielding plate around the second surface in the vertical direction; wherein the shield plate defines a plurality of insulative regions at least confronting and aligned with the corresponding second through holes in the vertical direction, respectively;

wherein said insulative region is an insulative layer coated upon the shielding plate.

16. The electrical connector as claimed in claim 15, wherein the through holes are dimensioned and configured to be used with core pins of a mold for supporting the shielding plate during the insert-molding process.

17. The electrical connector as claimed in claim 15, wherein a plurality of another through holes extend through the mating tongue in the vertical direction, aligned with the corresponding contacts around the first surface, respectively, and exposed to the exterior around the second surface once finishing the insert-molding process.

18. The electrical connector as claimed in claim 17, wherein the mating tongue forms at least one raised portion around the second surface corresponding to the first through holes, and the shielding plate forms at least one opening to receive said raised portion therein so as to isolate the shielding plate from said first through holes transversely.

* * * * *